United States Patent [19]

Schwartz et al.

[11] Patent Number: 4,652,232

[45] Date of Patent: Mar. 24, 1987

[54] APPARATUS AND METHOD TO ADD KINETIC ENERGY TO A LOW PRESSURE WASTE GAS FLARE BURNER

[75] Inventors: Robert E. Schwartz; Michael R. Keller, both of Tulsa, Okla.

[73] Assignee: John Zink Co., Tulsa, Okla.

[21] Appl. No.: 782,142

[22] Filed: Sep. 30, 1985

Related U.S. Application Data

[63] Continuation of Ser. No. 494,650, May 16, 1983, abandoned.

[51] Int. Cl.[4] ..... F23D 21/00

[52] U.S. Cl. ..... 431/202; 431/284

[58] Field of Search ..... 431/284, 354, 278, 202, 431/349, 4, 8, 5; 239/287, 448, 557

[56] References Cited

U.S. PATENT DOCUMENTS

| | | | |
|---|---|---|---|
| 220,736 | 10/1879 | Tirrill | 239/557 |
| 824,972 | 7/1906 | Borne | 239/557 |
| 2,521,584 | 9/1950 | Kuchne | 239/557 |
| 2,531,316 | 11/1950 | Zink | 431/284 |
| 3,164,200 | 1/1965 | Reed | 431/284 |
| 3,308,869 | 3/1967 | Livingston | 431/187 |
| 4,105,394 | 8/1978 | Reed et al. | 431/202 |
| 4,116,618 | 9/1978 | Straitz, III | 431/202 |
| 4,128,389 | 12/1978 | Straitz, III | 431/202 |
| 4,147,493 | 4/1979 | Straitz, III | 431/202 |
| 4,154,572 | 5/1979 | Reed et al. | 431/202 |
| 4,188,183 | 2/1980 | Zink et al. | 431/202 |
| 4,198,198 | 4/1980 | Straitz, III | 431/202 |
| 4,419,071 | 12/1983 | Schwartz | 431/202 |

*Primary Examiner*—Samuel Scott
*Assistant Examiner*—H. A. Odar
*Attorney, Agent, or Firm*—Head, Johnson & Stevenson

[57] ABSTRACT

A flre for burning low pressure waste gas wherein kinetic energy is imparted to the gas in a device having a central conduit for the low pressure waste gas and a plurality of radial arms surrounding the central conduit to which are supplied high pressure fluids at a steep upward angle to impart time-turbulence and temperature for creating 'stand-up' flare burning substantially unaffected by wind.

6 Claims, 5 Drawing Figures

APPARATUS AND METHOD TO ADD KINETIC ENERGY TO A LOW PRESSURE WASTE GAS FLARE BURNER

This is a continuation application of Ser. No. 494,650, filed May 16, 1983, now abandoned.

BACKGROUND OF THE INVENTION

This invention relates to the art of flaring low pressure hydrocarbon gases, smokelessly.

It is well known in the art that flaring of low pressure hydrocarbon gases having a molecular weight ratio of hydrogen to carbon less than 0.30 tends to produce smoke as a result of incomplete combustion and the formation of free carbon particles. The release of free carbon into the atmosphere creates a dark smoke plume which is unsightly and a matter of poor ecological practice. Various methods have been devised for coping with smoke generation. One method involves the introduction of a smoke suppressant, typically steam or water to the combustion zone. The water, in vapor phase, reacts with the hydrocarbon by familar and well known endothermal reactions. In some instances, the introduction of this suppressant also introduces air to assist in the complete combustion of the burning gases. Another method relates to the use of powered air for turbulent mixing of air with the hydrocarbon gas for more complete smokeless combustion.

There are instances in certain refineries, or process plants where neither steam or water or air powered turbulent mixing are available to smokelessly burn or flare low pressure hydrocarbon gases that are created as a part of the plant. The flaring of such gases is the only economical manner in which to handle these gases which must be removed from the system since they are not capable of being utilized elsewhere.

Wind is another problem with burning low pressure hydrocarbons above an elevated stack. If there is insufficient pressure to cause the flame to 'stand-up' the flames will 'lick' the side of the stack causing its destruction, besides the constant problem of maintaining ignition. Standing the flames upward is preferred.

SUMMARY OF THE INVENTION

It is a primary object of this invention to provide an apparatus which will impart additional energy to a low pressure waste gas which is to be flared since the gas, being a relatively low pressure cannot of its own energy inspirate the necessary combustion air for complete smokeless combustion.

It is a further object of the invention to provide elevated flare stack burning of low pressure waste gas, wherein the burning flame is caused to 'stand-up' or maintain an essentially vertical position above the stack.

It is a further object of this invention to achieve economy in the utilization of both a low pressure gas which is to be burned in a flare structure by the use of the energy of an available high pressure gas to provide the required turbulent air-gas mixture for complete smokeless combustion.

The flare apparatus of this invention for inducing or imparting the kinetic energy to a low pressure waste gas stream which is to be burned includes a burner structure having a low pressure waste gas supply conduit which terminates at a burning tip. A high pressure fluid manifold surrounds the supply conduit and includes, adjacent the tip a plurality of outwardly extending hollow arms. One or more openings in the top of each of the arms are angularly oriented such that high pressure gases being directed therefrom are directed inwardly and upwardly or along the direction of the axis of the low pressure gas conduit above the tip. Preferrably, the angle of said openings or the direction of high pressure gas flow is greater than 45° to the horizontal or tip surface. A high pressure fluid typically a gas is supplied to the manifold. The injection of the high pressure gas causes the inspiration of air and turbulence to the low pressure gases flowing from the center conduit for complete and smokeless combustion.

Another object of the invention is to provide a method of burning low pressure waste gases by the induction of additional kinetic energy thereto.

BRIEF DESCRIPTION OF THE DRAWINGS

Other objects and advantages of the invention and a better understanding of the principles and details of the invention will be evident in the following description taken in conjunction with the appended drawings in which.

DESCRIPTION OF THE PREFERRED EMBODIMENT

Before explaining the present invention in detail, it is to be understood that the invention is not limited in its application to the details of construction and arrangement of parts illustrated in the accompanying drawings, since the invention is capable of other embodiments and of being practised or carried out in a variety of ways. Also it is to be understood that the phraseology or terminology employed herein is for the purpose for description and not limitation.

Figure 1:
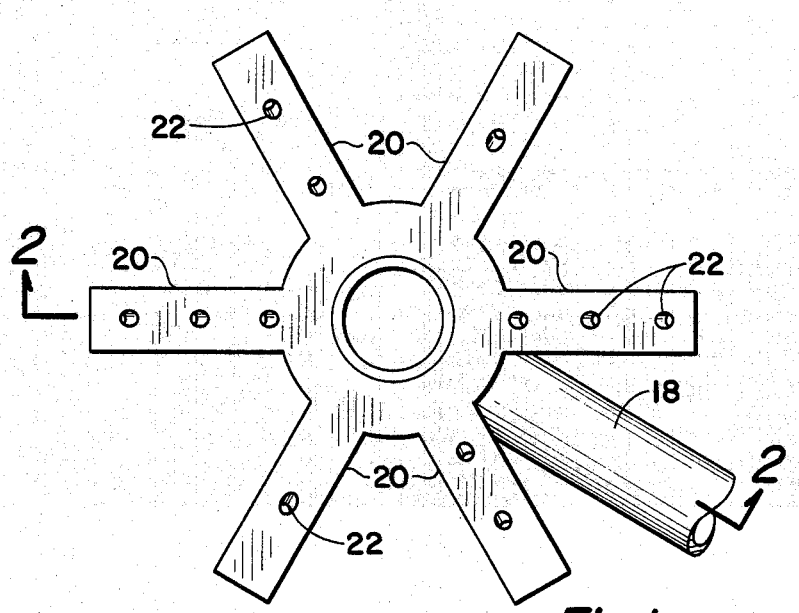
FIG. 1 is a top elevational view of the burner of this invention.
Figure 2:
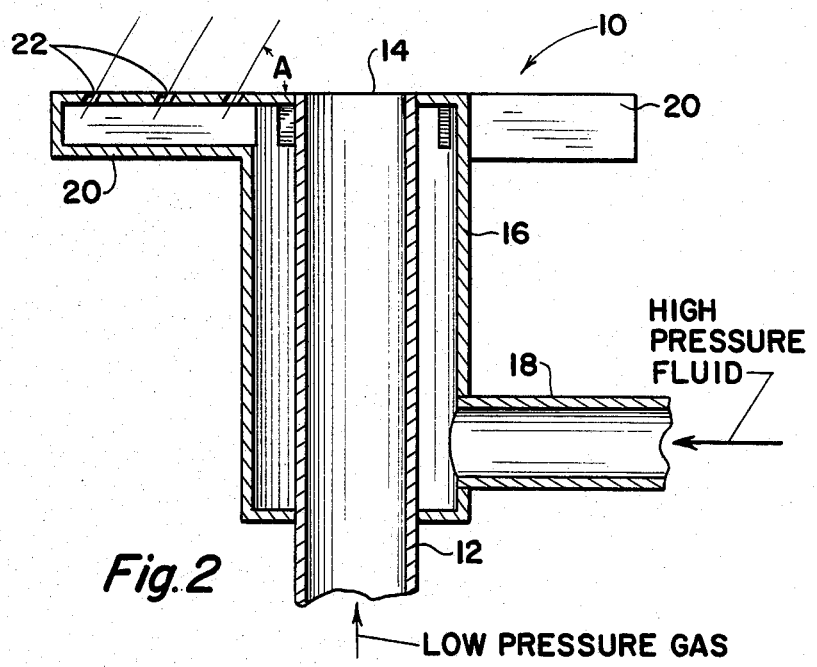
FIG. 2 is a sectional view taken along line 2—2 of FIG. 1.

Referring to FIGS. 1 and 2 the numeral 10 generally indicates the flare apparatus of this invention. The low pressure gas conduit 12 extends to a tip 14. Surrounding the conduit is a coaxial manifold 16 and a plurality of outwardly extending arms 20 that are in communication with the manifold 16. In each of the arms are one or more openings 22, of size and oriented to the horizontal or tip surface 14 so as to not only impart kinetic energy to the low pressure gas flowing upwardly in conduit 12 but also maintain the burning above tip 14 in a stand-up condition substantially unaffected by wind conditions. Preferrably, an angle A of at least 45° and openings 22 of size relative to the high pressure gas to create sonic velocity therefrom.

Figure 3:
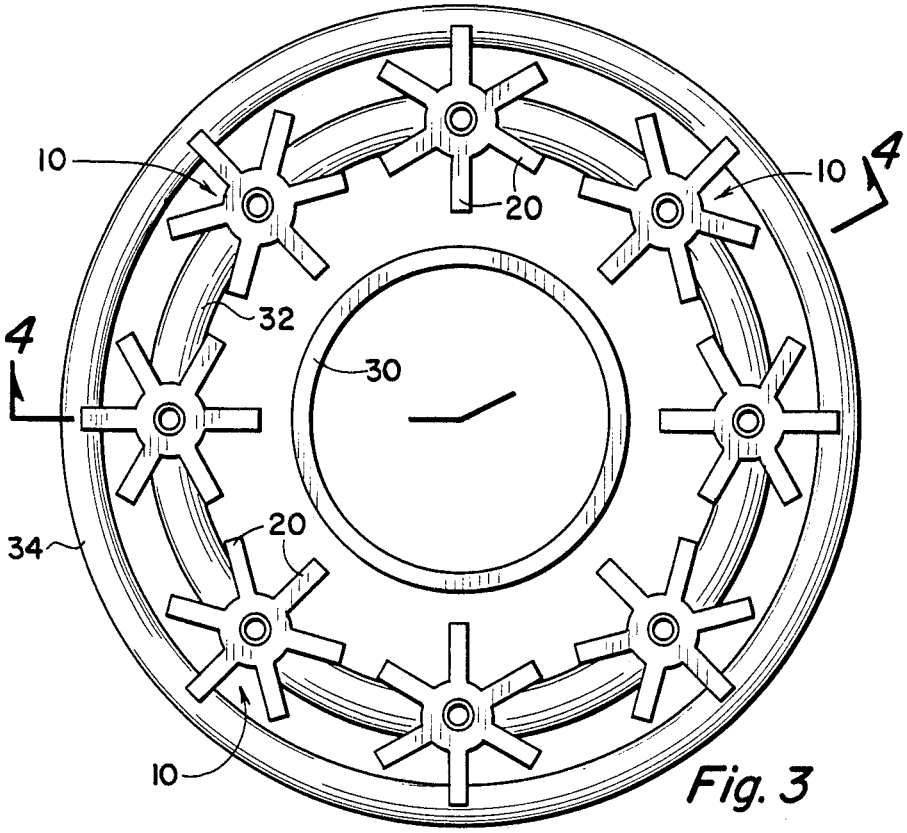
FIG. 3 is a top elevational view of a conventional flare stack which incorporates the burners of this invention about its tip.
Figure 4:
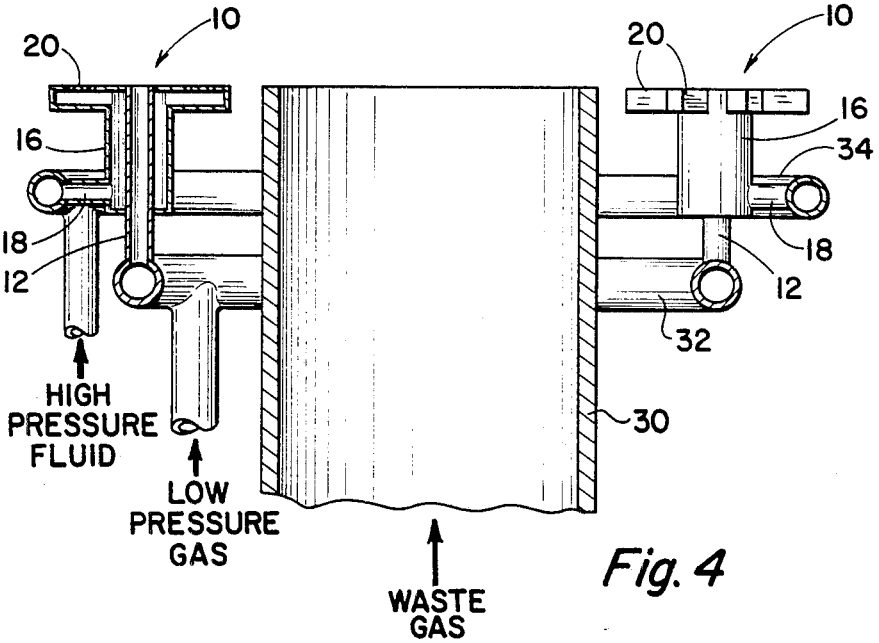
FIG. 4 is a sectional view taken along line 4—4 of FIG. 3.

FIGS. 3 and 4 indicate another embodiment of the use of the apparatus of this invention wherein like numerals are used for like parts as shown in FIGS. 1 and 2. In this embodiment a central emergency flare stack 30 is provided for venting large quantities of waste gas or high pressure waste gas, whichever the case may be.

Surrounding the tip of waste flare conduit 30 are one or more flare burner apparatus 10 extending circumferentially around the stack. Supply manifold 32 for the low pressure waste gas and 34 for the high pressure fluids are provided. This embodiment provides flexibility to plants where low pressure and high pressure waste gases are to be flared.

Figure 5:
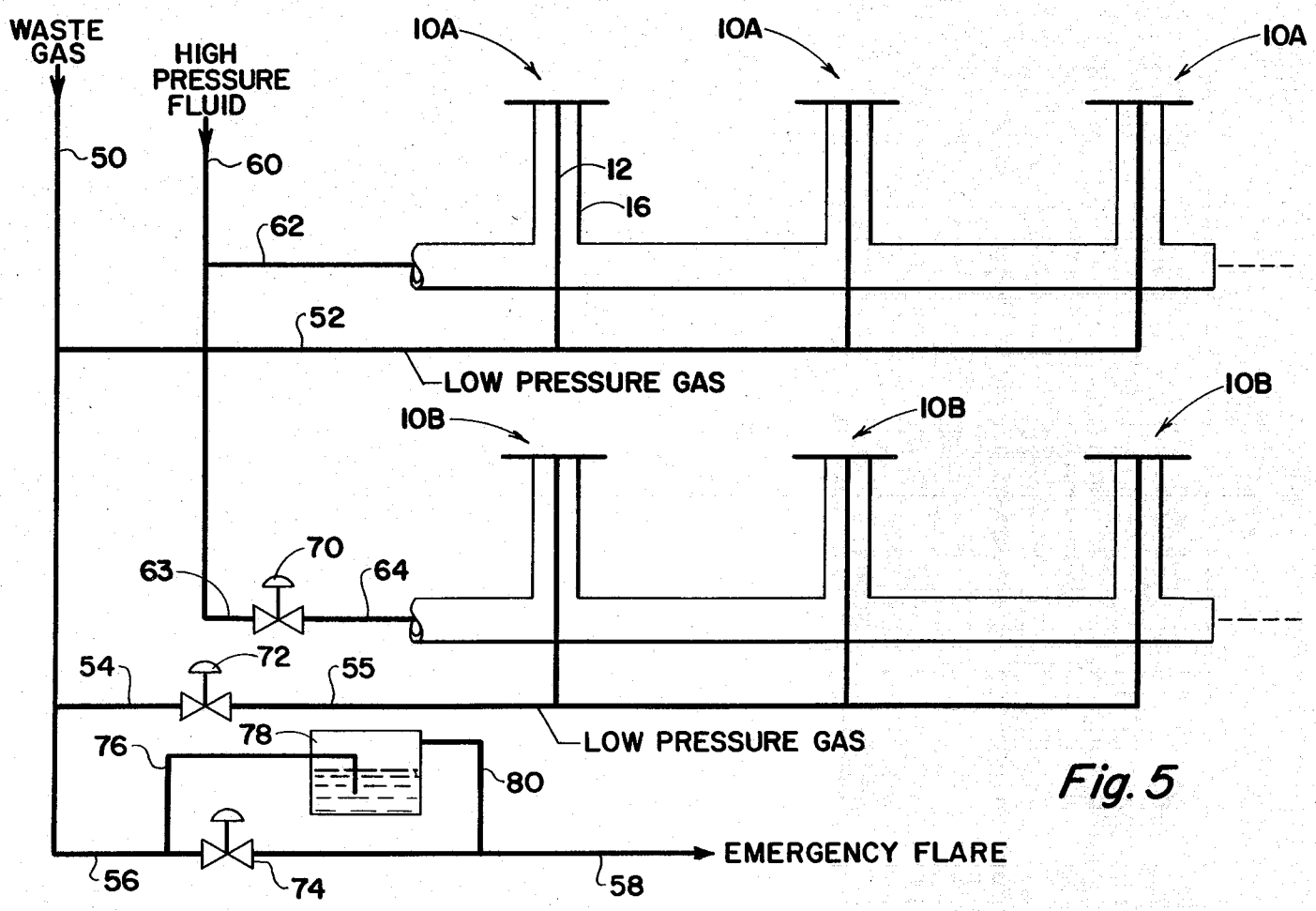
FIG. 5 is a schematic view of an embodiment of the invention showing a sequential flow of waste gases from a low pressure condition to a high pressure condition utilizing the apparatus of this invention to in-line burners as used in a ground level flare burning system.

The embodiment of FIG. 5 represents a flow sequential system for waste gases which may vary at low flow or pressure rates to an extreme high flow or pressure rate. During normally low pressure or low flow conditions waste gas enters via conduit 50 and 52 to one or more burners 10*a* via conduit 12. Likewise, high pressure gas will enter via conduit 60 through 62 into the manifold system 16 surrounding the low pressure conduit 12 as best shown in FIG. 2. In the event the flow or pressure of the inlet waste gas via 50 should increase a second set of burners 10*b* will come into use. This occurs by sensing the pressure or flow condition in waste gas inlet 50 which will then operate valve 70 controlling the high pressure fluid and valve 72 to the low pressure gas which will allow for passage through respective conduits 63 and 64 and 54 and 55. Further increase in flow or pressure of the waste gas via conduit 50 additional burner systems 10*c*, 10*d*, etc. may be utilized or an emergency flare which can handle larger quantities of gas may be provided by flow through conduit 56 and thence 58. The flow being controlled by valve 74 and/or flow control through pipe 76 into a water seal 78, the outlet 80 of which will enter conduit 58 to an emergency flare stack, not shown.

The high pressure fluids useful in the apparatus of this invention includes gaseous or vaporous smoke suppressants, such as steam or air, inert gases or combustible high pressure gases.

What is claimed is:

1. Flare apparatus for inducing kinetic energy to low pressure waste gas which is to be burned substantially smokelessly, comprising:

an array of burners, each of said burners defined by a tip and a central, internally unobstructed, conduit which terminates at an axial discharge opening at said tip;

means to supply said low pressure waste gas to said conduit for axial and linear discharge above said tip;

a manifold surrounding said conduit and forming an annular chamber thereabout which manifold includes, adjacent said tip, a plurality of arms which are in communication with said annular chamber and radially directed outwardly of said annular chamber, the top of said arms being along or below a plane formed across the top of said tip, at least one opening formed in the top of at least one of said arms, the axis of each opening being directed inwardly and primarily toward the direction along said axial discharge of said low pressure gas above the tip; and means to supply a high pressure fluid from said manifold to the upstream side of each said opening in said arms.

2. The flare apparatus of claim 1 wherein said waste gas is of pressure not more than 5 p.s.i.g.

3. The flare apparatus of claim 1 wherein said array of burners is circular.

4. The flare apparatus of claim 1 wherein the angle of said axis of each said opening being no less than 45°.

5. The flare apparatus of claim 1 wherein said array of burners is in line.

6. The flare of claims 1, 2, 3 or 5 wherein said high pressure fluid is gaseous including one of steam, air, inert gas, and combustible gas.

* * * * *